US010809040B2

(12) United States Patent
Kim

(10) Patent No.: US 10,809,040 B2
(45) Date of Patent: Oct. 20, 2020

(54) SMART ELECTRIC SHOCK DEVICE

(71) Applicant: INFOS Technology Co., Ltd., Seoul (KR)

(72) Inventor: Beom Jin Kim, Seoul (KR)

(73) Assignee: INFOS TECHNOLOGY CO., LTD., Seoul (KR)

( * ) Notice: Subject to any disclaimer, the term of this patent is extended or adjusted under 35 U.S.C. 154(b) by 237 days.

(21) Appl. No.: 16/172,170

(22) Filed: Oct. 26, 2018

(65) Prior Publication Data

US 2019/0128650 A1 May 2, 2019

(30) Foreign Application Priority Data

Oct. 27, 2017 (KR) ..... 10-2017-0140883

(51) Int. Cl.
*F41H 13/00* (2006.01)
*F41G 1/35* (2006.01)

(52) U.S. Cl.
CPC ..... *F41H 13/0025* (2013.01); *F41G 1/35* (2013.01)

(58) Field of Classification Search
CPC ..... F41H 13/0025; F41G 1/35
USPC ..... 361/232
See application file for complete search history.

(56) References Cited

U.S. PATENT DOCUMENTS 191,178 A * 5/1877 Richardson ..... F41A 9/28 42/59
8,441,771 B2 5/2013 Hinz et al.
2005/0034593 A1* 2/2005 LeBourgeois ..... F42B 12/36 89/1.11
2014/0098453 A1* 4/2014 Brundula ..... F41B 15/04 361/232
2016/0169615 A1* 6/2016 Berger ..... F41B 11/68 124/73
2017/0245355 A1* 8/2017 Handel ..... H05C 3/00

FOREIGN PATENT DOCUMENTS

CN 101105382 B 1/2012
KR 2003-01948 B1 1/2003
KR 10-2008-0043770 A 5/2008

OTHER PUBLICATIONS

Korean Intellectual Property Office, Notice of Allowance, Korean Patent Application No. 10-2017-0140883, dated Jun. 21, 2018, 6 pages (with concise explanation of relevance).

* cited by examiner

*Primary Examiner* — Kevin J Comber
(74) *Attorney, Agent, or Firm* — Fenwick & West LLP

(57) ABSTRACT

Disclosed herein is a smart electroshock device. The smart electroshock device includes: a main body provided therein with electronic components to launch a projectile, the projectile being adapted to be stuck in a target and apply an electric shock to the target; a cylinder body coupled to one side of the main body via a hinge and comprising a cylinder; and a plurality of cartridges mounted in the cylinder and each comprising the projectile, wherein the projectile is launched from the cylinder through manipulation of the main body, and the cylinder is rotatably coupled to the cylinder body. The smart electroshock device according to the present invention can launch a plurality of projectiles consecutively using a revolving cylinder. In addition, the smart electroshock device can be used as a stun gun without removing a projectile in the cartridge which is in a state to be launched.

33 Claims, 15 Drawing Sheets

SMART ELECTRIC SHOCK DEVICE

CROSS-REFERENCE TO RELATED APPLICATION

This application claims priority to and the benefit of Korean Patent Application No. 10-2017-0140883, filed on Oct. 27, 2017, which is incorporated by reference for all purposes as if fully set forth herein.

FIELD

The present invention relates to a smart electroshock device, and more particularly, to a smart electroshock device which can immobilize a target by delivering an electric shock to the target.

BACKGROUND

Typical electroshock devices immobilize a target such as humans or animals by launching at least one electrode for delivering an electrical stimulus signal to the target. One example of such electronic devices is disclosed in U.S. Pat. No. 8,441,771. An electroshock device disclosed in this patent is designed to launch two electrodes at the same time to deliver electricity to a target to immobilize the target.

In this electroshock device, after two projectiles are launched, a cartridge in which the two projectiles have been mounted cannot be reused. That is, for this electroshock device, it is necessary to replace the used cartridge with a new one prior to the next launch.

Although, in some cases, a cartridge adapted to launch projectiles twice or more in succession may be used in the electroshock device, after all the projectiles in the cartridge are launched, the cartridge also needs to be replaced with a new one.

In addition, the electroshock device disclosed in this patent may also be used as a stun gun capable of discharging high voltage electricity. However, in order to use the electroshock device as a stun gun, it is necessary to remove projectiles in the cartridge in advance.

One example of the background technique is disclosed in U.S. Pat. No. 8,441,711 (May 14, 2013).

SUMMARY

Embodiments of the present invention provide a smart electroshock device which can launch a plurality of projectiles consecutively only by replacing the projectiles without replacing a cartridge.

Embodiments of the present invention provide a smart electroshock device which can be operated as a stun gun without taking an additional action such as removal of a projectile in a cartridge which is in a state to be launched.

In accordance with one aspect of the present invention, a smart electroshock device includes: a main body provided therein with electronic components to launch a projectile, the projectile being adapted to be stuck in a target and apply an electric shock to the target; a cylinder body coupled to one side of the main body via a hinge and including a cylinder; and a plurality of cartridges mounted in the cylinder and each including the projectile, wherein the projectile is launched from the cylinder through manipulation of the main body, and the cylinder is rotatably coupled to the cylinder body.

The main body may include: a trigger operated to launch the projectile; a high voltage generator supplying high voltage power to the projectile to launch the projectile; and a power source supplying power to the high voltage generator.

The main body may further include a display portion coupled to the main body to display operation status of a circuit and operation state and amount of charge in a battery and to control functions of the smart electroshock device.

The trigger may include a trigger bar formed at one side of the trigger, and the smart electroshock device may further include at least one trigger bar detection unit detecting movement of the trigger bar.

The smart electroshock device may further include a plurality of laser units emitting a laser beam toward a point of the target in which the projectile will be stuck, wherein the at least one trigger bar detection unit may include a first trigger bar detection unit and a second trigger bar detection unit, and each of the plurality of the laser units may emit a laser beam when the trigger bar is not detected by the first trigger bar detection unit and the second trigger bar detection unit.

When the first trigger bar detection unit detects the trigger bar, the projectile is not launched, and, when the second trigger bar detection unit detects the trigger bar, the projectile is launched.

The smart electroshock device may further include a display portion coupled to the main body, wherein whether to operate the plurality of laser units may be controlled through manipulation of the display portion.

The smart electroshock device may further include a flash disposed on a front side of the cylinder body to emit light in a launch direction of the projectile.

The power source may be a battery, wherein the battery may include an indicator showing an amount of charge in the battery and an indicator control button activating the indicator.

The battery may be a rechargeable secondary battery, wherein the secondary battery may include a charging circuit to be charged by a DC power supply without an external charging device.

The smart electroshock device may further include a stun generator disposed on a front side of the cylinder body to discharge high voltage electricity supplied from the high voltage generator.

The main body may further include a stun button for discharging high voltage electricity from the stun generator.

The smart electroshock device may further include a switch circuit disposed in the main body and electrically connected to the high voltage generator to apply high voltage to the plurality of cartridges or the stun generator.

The smart electroshock device may further include a capacitor disposed in the main body and electrically connected to the high voltage generator, wherein the capacitor removes high voltage electricity remaining in the stun generator after discharge of high voltage from the stun generator.

The smart electroshock device may further include: a safety lever disposed in the main body to shut off power to the projectile such that the projectile is not launched, the safety lever including a safety lever bar formed at one side thereof; and a safety lever bar detection unit detecting the safety lever bar.

The safety lever may be rotatable and the safety lever bar detection unit may detect the safety lever bar corotating with the safety lever.

The cylinder body may be formed with a latch for coupling the cylinder body to the main body; the main body may be formed with a catch groove allowing the latch to be caught therein; and the smart electroshock device may further include a cylinder separation button disposed in the main body to unlock the latch to separate the cylinder body from the main body.

The cylinder body may be pivotable about the hinge when separated from the main body.

The smart electroshock device may further include: a magnet disposed in any one of the cylinder body and the main body; and a magnetic detection unit disposed in the other to detect a magnetic field from the magnet, wherein, when the magnetic field from the magnet is not detected by the magnetic detection unit, power to the projectile is shut off such that the projectile is not launched.

The smart electroshock device may further include: a coupler base disposed in the main body to rotate the cylinder; and a coupler revolver rotating the cylinder through rotation of the coupler base.

The coupler base may not be rotated during operation to launch the projectile and may be rotated while the trigger is returned to an original position thereof to move the next projectile mounted in the cylinder to a launch position.

The smart electroshock device may simultaneously launch two projectiles from the cylinder, wherein the two projectiles may be launched at predetermined angles to one another.

The plurality of laser units may include two laser units, wherein a laser beam from one laser unit may form a predetermined angle with a laser beam from the other laser unit.

After being launched, the projectile may be supplied with high voltage power from the main body via a wire connected to the projectile through a muzzle formed in the cylinder body, and the smart electroshock device may further include: a blade rotor disposed in front of the cylinder to cut the wire; and a blade base disposed in front of the blade rotor to cut the wire in cooperation with the blade rotor when the blade rotor is rotated.

The blade rotor may corotate with the cylinder.

The blade base may be formed with a hole through which the wire passes, wherein the hole may have an inclined surface.

The cartridge may include: the projectile including an electrode needle formed at one end thereof to be stuck in the target; an inner case receiving the projectile; a wire connected to the projectile and wound around an outer circumferential surface of the inner case; an outer case open at one end thereof to allow the projectile to be launched therethrough, receiving the inner case, and electrically connected to the wire; a detonator case sealing the other end of the outer case; and a detonator disposed inside the detonator case to launch the projectile.

The detonator case may be open at one end thereof and may have an accommodation space therein, and the cartridge may further include: a detonator holder disposed inside the detonator case and receiving the detonator; a wad covering the open end of the detonator case; and an electrode pad disposed outside the detonator case to transmit electric power to the detonator.

The cartridge may further include a cover covering the open end of the outer case.

The smart electroshock device may further include: a plurality of electrodes disposed in the main body and contacting the electrode pad to transmit electric signals for launching the projectile to the detonator through the electrode pad.

One of the plurality of electrodes may transmit an electric signal to the detonator holder through the detonator case and another one may transmit an electric signal to the detonator.

The smart electroshock device may further include: a first contact disposed in the cylinder such that one end thereof is exposed inside a cartridge insertion hole formed in the cylinder and receiving the cartridge and the other end thereof protrudes from an outer surface of the cylinder; and a second contact disposed in the cylinder body to transmit high voltage power to the outer case of the cartridge through the first contact.

The smart electroshock device may further include: a gyro sensor disposed in the main body to measure a launch angle of the projectile; and a gyro circuit controlling the smart electroshock device not to launch the projectile when the launch angle of the projectile measured by the gyro sensor falls outside a predetermined range.

In accordance with another aspect of the present invention, a smart electroshock device includes: a main body provided therein with electronic components to launch a projectile, the projectile being adapted to be stuck in a target and apply an electric shock to the target; a cylinder body coupled to the main body and including a cylinder; a plurality of cartridges mounted in the cylinder and each including the projectile, wherein the projectile is launched from the cylinder through a muzzle formed on a front side of the cylinder body through manipulation of the main body; and a stun generator disposed on the front side of the cylinder body to discharge high voltage electricity through manipulation of the main body.

According to exemplary embodiments, the smart electroshock device can launch plural projectiles consecutively using a revolving cylinder. In addition, since a plurality of cartridges each including one projectile is mounted in the cylinder, the smart electroshock device can be easily reloaded with new projectiles, like a revolver.

Further, since a stun generator is disposed on a front side of the cylinder body, a user can use the smart electroshock device as a stun gun regardless of whether the plurality of cartridges including the projectile is mounted in the cylinder or not.

BRIEF DESCRIPTION OF DRAWINGS

The accompanying drawings, which are included to provide a further understanding of the disclosed technology, and are incorporated in and constitute a part of this specification, illustrate exemplary embodiments of the disclosed technology, and together with the description serve to describe the principles of the disclosed technology.

DETAILED DESCRIPTION

Hereinafter, embodiments of the present invention will be described with reference to the accompanying drawings.

Figure 1:
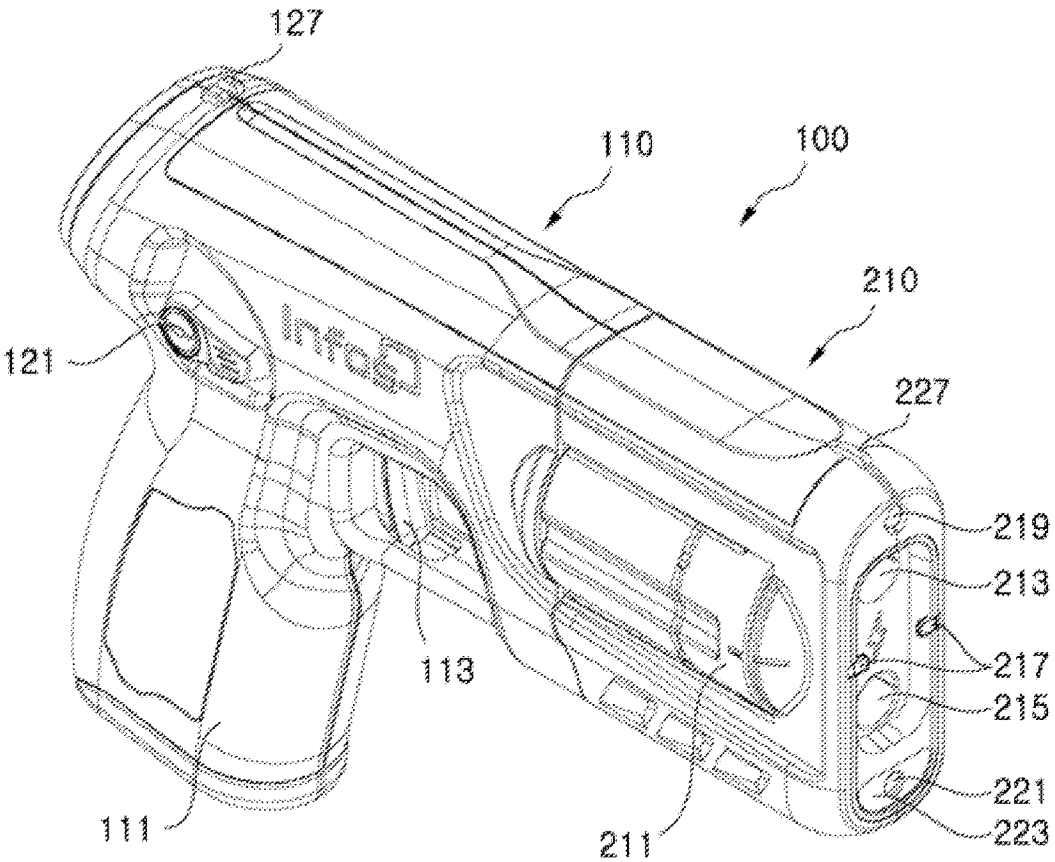
FIG. 1 is a perspective view of one side of a smart electroshock device according to one embodiment of the present invention.
Figure 2:
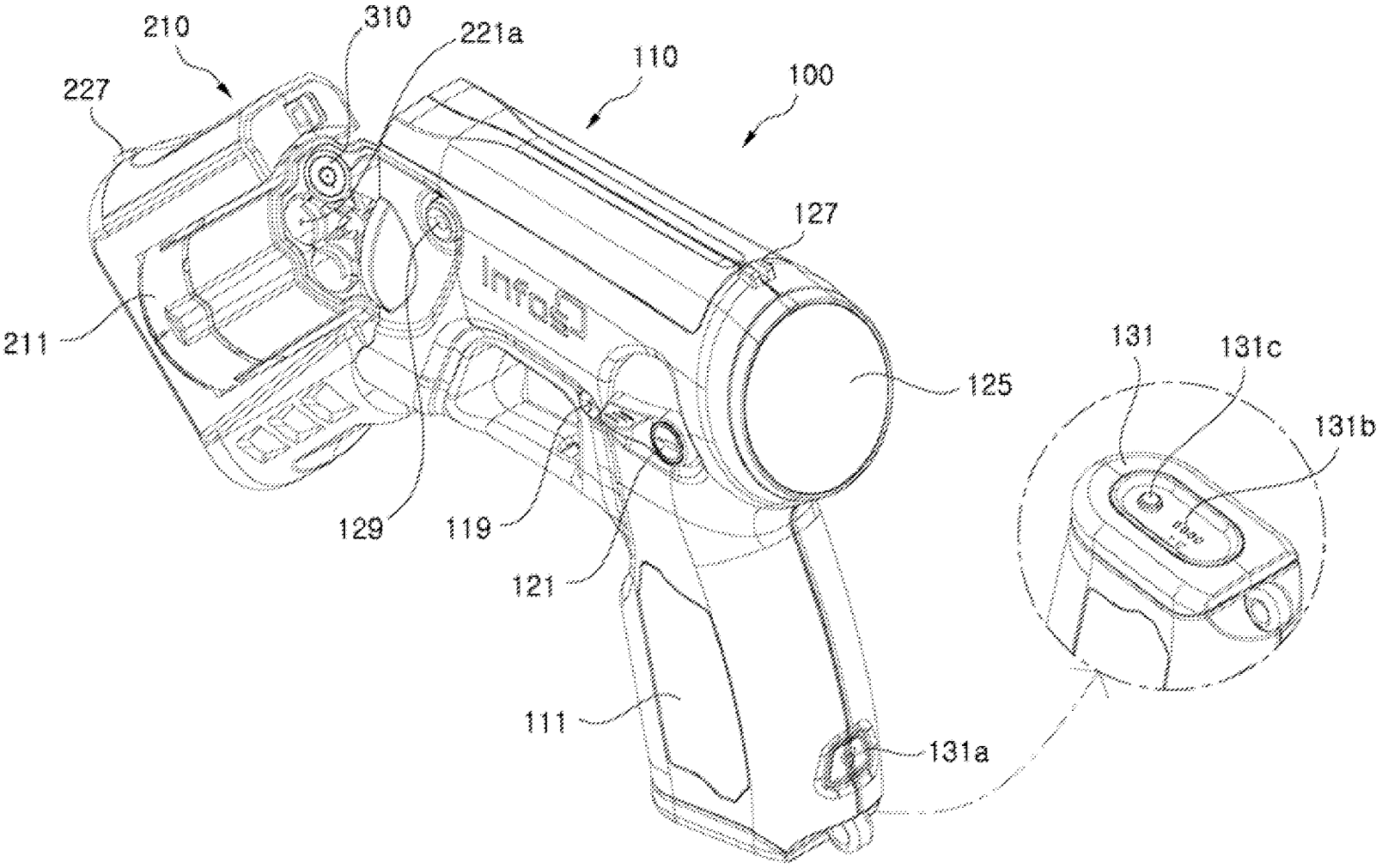
FIG. 2 is a perspective view of the other side of the smart electroshock device according to the embodiment.
Figure 3:
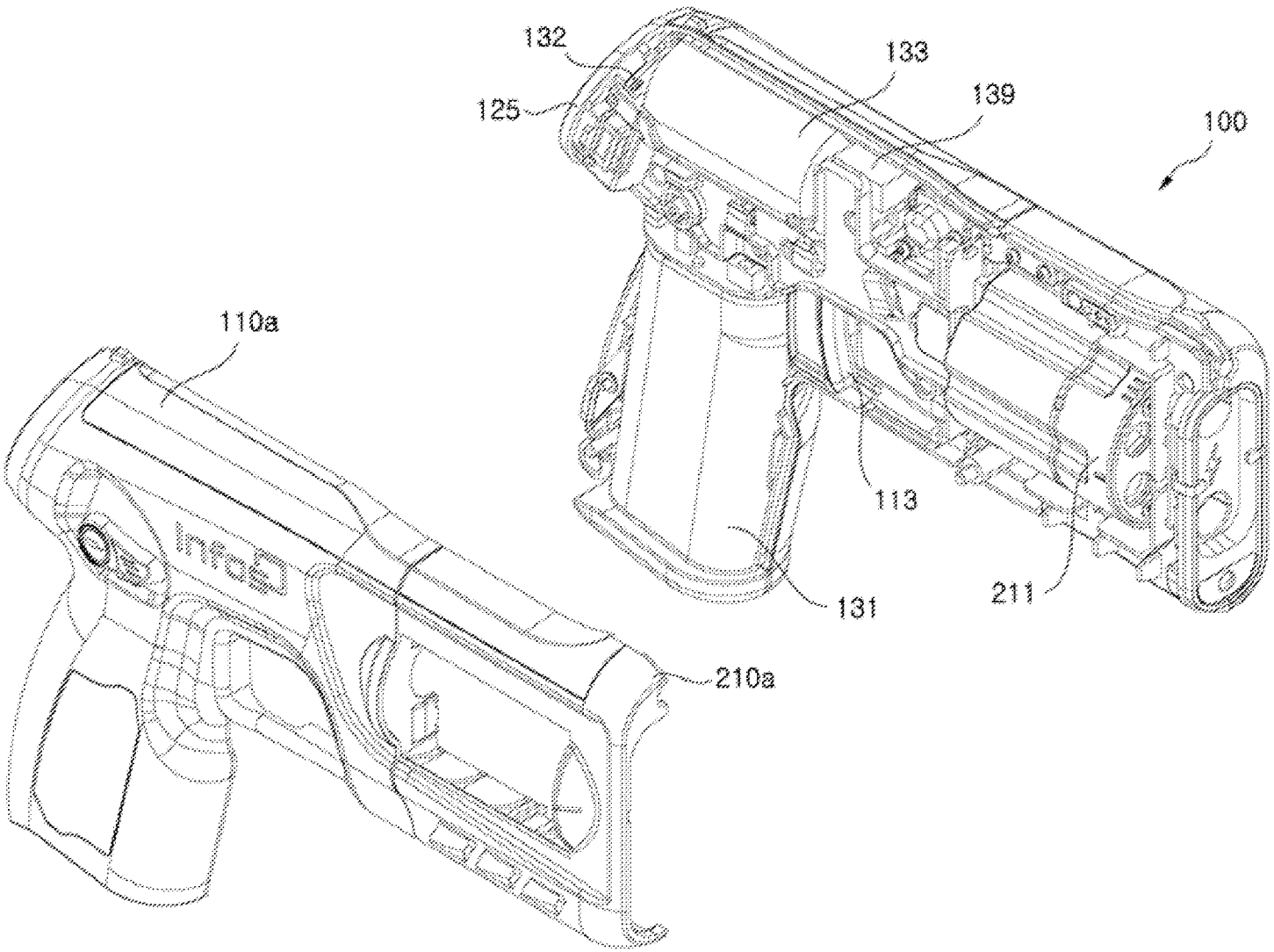
FIG. 3 is a perspective view of an internal structure of the smart electroshock device according to the embodiment.

FIG. 1 is a perspective view of one side of a smart electroshock device according to one embodiment of the present invention, FIG. 2 is a perspective view of the other side of the smart electroshock device according to the embodiment, and FIG. 3 is a perspective view of an internal structure of the smart electroshock device according to the embodiment.

A smart electroshock device 100 according to one embodiment of the present invention includes: a main body 110; a cylinder body 210, and a cartridge 310 including a projectile 317. Although the projectile 317 is not shown in FIG. 1 to FIG. 3, the projectile 317 is described with reference to FIG. 9 for convenience. Details of the projectile will be described further below with reference to the subsequent drawings.

The main body 110 is adapted to be grasped by a user and may be manipulated to launch the projectile 317 from the smart electroshock device 100 or discharge electricity from a stun generator 217. The main body 110 includes a grip portion 111, a trigger 113, a stun button 119, a safety lever 121, a display portion 125, a rear sight 127, a cylinder separation button 129, a battery 131, a stun generator 217, and a communication module 139.

In addition, the main body 110 may include at least one circuit unit 132 including a predetermined circuit which operatively connects one component of the main body 110 to another component.

The grip portion 111 is adapted to allow a user to grasp the smart electroshock device 100. The grip portion 111 may be disposed at a lower portion of the smart electroshock device 100 to form a predetermined angle with the vertical direction.

The trigger 113 is adapted to launch the projectile 317 from the smart electroshock device 100 and is bidirectionally movable a predetermined distance in a longitudinal direction of the smart electroshock device 100. When the trigger 113 is moved toward a user grasping the smart electroshock device 100, the projectile 317 can be launched from the smart electroshock device 100. Here, the movement of the trigger 113 toward the user is induced by external force.

The trigger 113 is disposed at the lower portion of the smart electroshock device 100 at one side of the grip portion 111. Accordingly, when a user holds the grip portion 111 by one hand, the trigger 113 can be in a position where a user can pull the trigger with the forefinger or middle finger of the hand.

The stun button 119 serves as a switch for discharging electricity from the stun generator 217 of the smart electroshock device 100. In this embodiment, the stun button 119 is disposed on the left of the display portion 125, as shown in FIG. 2. Specifically, the stun button may be disposed between the trigger 113 and the grip portion 111. However, it should be understood that the present invention is not limited thereto and the position of the stun button 119 may be changed, as needed.

The safety lever 121 is disposed above the grip portion 111 and is adapted to set whether to operate the smart electroshock device 100. The safety lever 121 is rotatable in a predetermined direction. Whether to operate the smart electroshock device 100 is set according to the position of the safety lever 121. As shown in FIG. 1 and FIG. 2, in this embodiment, the safety lever 121 includes a pair of safety levers disposed on respective opposite sides of the smart electroshock device 100, wherein the pair of safety levers 121 may be operated simultaneously.

When the safety lever 121 is moved to a position to disable operation of the smart electroshock device 100, the smart electroshock device 100 is powered off, such that the projectile 317 is not launched even when a user pulls the trigger 113 and electricity is not discharged from the stun generator 217 even when the user press the stun button 119.

However, it should be understood that the present invention is not limited thereto and the pair of safety levers 121 disposed on respective opposite sides of the smart electroshock device 100 may be adapted to perform different functions, as needed. For example, a left safety lever 121 may control whether to launch the projectile 317 from the smart electroshock device 100 and a right safety lever 121 may control whether to discharge electricity from the stun generator 217.

The display portion 125 serves to inform a user of operation status of the smart electroshock device 100. In addition, the display portion may also display information about the position or operational log of the smart electroshock device 100, as needed. In this embodiment, the display portion 125 is disposed at a rear upper portion of the smart electroshock device 100, such that the user grasping the smart electroshock device 100 can easily check the operation status of the smart electroshock device 100 through the display portion 125. Here, examples of information displayed by the display portion 125 may include the operation status of circuits and the amount of charge remaining in the battery.

The display portion 125 may be provided in the form of a touchscreen which allows a user to select options to control each function of the smart electroshock device 100 by touching the screen with a finger or the like, as needed.

The rear sight 127 is used to determine a point of a target at which the projectile 317 launched from the smart electroshock device 100 will arrive, in cooperation with a front sight 227 disposed on the cylinder body 210. The rear sight 127 may consist of a groove formed in the longitudinal direction of the smart electroshock device 100 and two upward protrusions flanking the groove. In this embodiment, the rear sight 127 and the front sight 227 may be adapted to determine a point of the target at which the projectile 317 launched through a first muzzle 213 will arrive.

The cylinder separation button 129 is adapted to separate the cylinder body 210 from the main body 110. That is, when a user presses the cylinder separation button 129, the cylinder body 210 is separated from the main body 110. In this embodiment, the cylinder body 210 is coupled at a lower portion thereof to the main body 110 via a hinge, as described below, such that, when the cylinder separation button 129 is pressed, an upper portion of the cylinder body 210 is separated from the main body 110 to be pivoted about the hinge, as shown in FIG. 2, rather than that the cylinder body being completely separated from the main body 110. Accordingly, with the cylinder separation button pressed, the cartridge 310 can be inserted into or removed from the cylinder 211.

The battery 131 is adapted to supply power to the smart electroshock device 100. In this embodiment, the battery 131 is disposed inside the grip portion 111. In this embodiment, the battery 131 is detachably mounted in the smart electroshock device 100. Accordingly, a battery release button 131*a* may be disposed on a rear side of the grip portion 111. When a user presses the battery release button 131*a*, the battery 131 may be released through a bottom of the grip portion 111.

Referring to FIG. 2, in this embodiment, the smart electroshock device may further include an indicator 131*b* (e.g., a plurality of LEDs) disposed on a lower surface of the battery 131 to show the remaining charge in the battery 131 and a check button 131*c* disposed at one side of the indicator 131*b* to activate the indicator. With the check button 131*c* and the indicator 131*b* provided to the battery 131, the user can check the amount of charge in the battery 131 regardless of whether the battery 131 is mounted in the electroshock device 100 or released from the electroshock device.

In this embodiment, the battery 131 may be a rechargeable secondary battery and may include a charging circuit which can recharge the battery 131 with a DC power supply without any separate charger.

A high voltage generator 133 is electrically connected to the battery 131 to receive power from the battery 131 to generate high voltage. As shown in FIG. 3, the high voltage generator 133 may be disposed above the battery 131, without being limited thereto. High-voltage power generated by the high voltage generator 133 may be delivered to the cartridge 310 mounted in the cylinder 211 of the cylinder body 210 or the stun generator 217 via internal wires and the circuit unit 132.

In this embodiment, the communication module 139 is adapted to receive a signal from a navigation satellite to identify the location of the smart electroshock device 100. That is, the communication module 139 may be a GPS antenna receiving signals from the navigation satellite and may include an electronic component and an antenna that can be connected to a mobile communication network or the Internet, as needed.

In addition, the communication module 139 may store information on the operation status of the smart electroshock device 100, as needed. Here, examples of information stored in the communication module 139 may include information on the position and launch angle of the smart electroshock device 100 and user login information. Thus, the communication module 139 may further include a memory storing the information and a gyro sensor detecting the launch angle of the projectile 317.

The gyro sensor serves to detect the launch angle of the projectile 317 from the smart electroshock device 100. If the launch angle of the projectile 317 detected by the gyro sensor falls outside a predetermined range, the smart electroshock device is controlled not to launch the projectile 317. The circuit unit 132 may have a function to control whether to launch the projectile 317 based on the detected launch angle of the projectile 317.

The communication module 139 may further include an electronic component capable of short-range communication, such as a Bluetooth device. Accordingly, through short-range communication with a wireless communication device such as a smartphone, the communication module 139 may control the wireless communication device to issue an alarm when the smart electroshock device 100 is separated from the wireless communication device by a predetermined distance (for example, 5 meters). In addition, through communication with the wireless communication device, the communication module 139 may control an application installed in the wireless communication device to issue an alarm to prevent the smart electroshock device 100 from being lost or stolen.

As described above, the cylinder body 210 is coupled at one side thereof to the main body 110 via a hinge. Accordingly, the cylinder body 210 can be pivoted about the hinge with the lower portion of the cylinder body 210 coupled to the main body 110, as shown in FIG. 2. The cylinder body 210 includes the cylinder 211, a first muzzle 213, a second muzzle 215, the stun generator 217, a first laser unit 219, a second laser unit 221, a flash 223, and the front sight 227.

In addition, the cylinder body 210 may include a plurality of electrical wires extending from the main body 110 through the lower portion of the cylinder body hinged to the main body 110. Accordingly, electric power can be delivered from the main body 110 to the cartridge 310, the stun generator 217, the first laser unit 219, the second laser unit 221, and the flash 223 through the plurality of electrical wires.

The cylinder 211 is coupled to the cylinder body 210 to be revolvable about an axis corresponding to the longitudinal direction of the smart electroshock device 100, as shown in FIG. 1 to FIG. 3. The cylinder 211 is formed with a plurality of cartridge insertion holes 211*a* each receiving the cartridge 310. In this embodiment, the cylinder 211 is formed with six cartridge insertion holes 211*a*.

The cylinder body 210 is formed on a front side thereof with the first muzzle 213, the second muzzle 215, the stun generator 217, the first laser unit 219, the second laser unit 221, and the flash 223. Each of the first muzzle 213 and the second muzzle 215 allows the projectile 317 to be launched therethrough when the trigger 113 is pulled. Here, two projectiles 317 are simultaneously launched through the first muzzle 213 and the second muzzle 215, respectively. In this embodiment, the first muzzle 213 and the second muzzle 215 extend parallel to one another with a predetermined distance therebetween in the vertical direction. However, it should be understood that the present invention is not limited thereto and each of the first muzzle and the second muzzle may extend at a predetermined angle (e.g., two degrees) with respect to the central axis.

The stun generator 217 generates an electric discharge when the stun button 119 is pressed. In this embodiment, the stun generator 217 includes two electrodes horizontally arranged to be separated a predetermined distance from one another. Accordingly, a high-voltage electric discharge can be generated between the two electrodes.

Here, electricity discharged from the stun generator 217 may be high-voltage electricity applied from the high voltage generator 133. If a user touches the stun generator 217 after the stun button 119 is pressed by the user and a high-voltage electric discharge is generated by the stun generator 217, there is a risk that the user will be shocked by high-voltage electricity remaining in the stun generator 217. In order to prevent this risk, the smart electroshock device 100 may further include a capacitor electrically connected to the high voltage generator 133. The capacitor serves to remove high-voltage electricity remaining in the stun generator 217. Here, the capacitor may be included in the circuit unit 132.

The first laser unit 219 and the second laser unit 221 are disposed on the front side of the cylinder body 210. Specifically, the first laser unit 219 is disposed above the first muzzle 213 and the second laser unit 221 is disposed below the second muzzle 215. A laser beam from the first laser unit 219 is pointed at a point of a target at which a projectile 317 launched through the first muzzle 213 will arrive, and a laser beam from the second laser unit 221 is pointed at a point of the target at which a projectile 317 launched through the second muzzle 215 will arrive. In this embodiment, each of the first laser unit 219 and the second laser unit 221 may emit a laser beam when a user moves the safety lever 121 to a use position. Alternatively, the display portion 125 may be configured as a touch pad such that whether to operate the first laser unit 219 and the second laser unit 221 can be controlled through manipulation of the display portion 125.

The flash 223 may be disposed around the second laser unit 221 on the front side of the cylinder body 210. The flash 223 may turn on when a user moves the safety lever 121 to the use position. Alternatively, whether to operate the flash 223 may be controlled through manipulation of the display portion 125.

The cartridge 310 contains one projectile 317. The projectile 317 in the cartridge is launched by electric power supplied from outside. Details of the cartridge 310 will be described further below with reference to the related drawings.

Referring to FIG. 3, two main body covers 110*a* may be assembled into the main body and two cylinder body covers 210*a* may be assembled into the cylinder body 210.

Next, operation of each component of the smart electroshock device 100 will be described with reference to FIG. 4 to FIG. 16.

Figure 4:
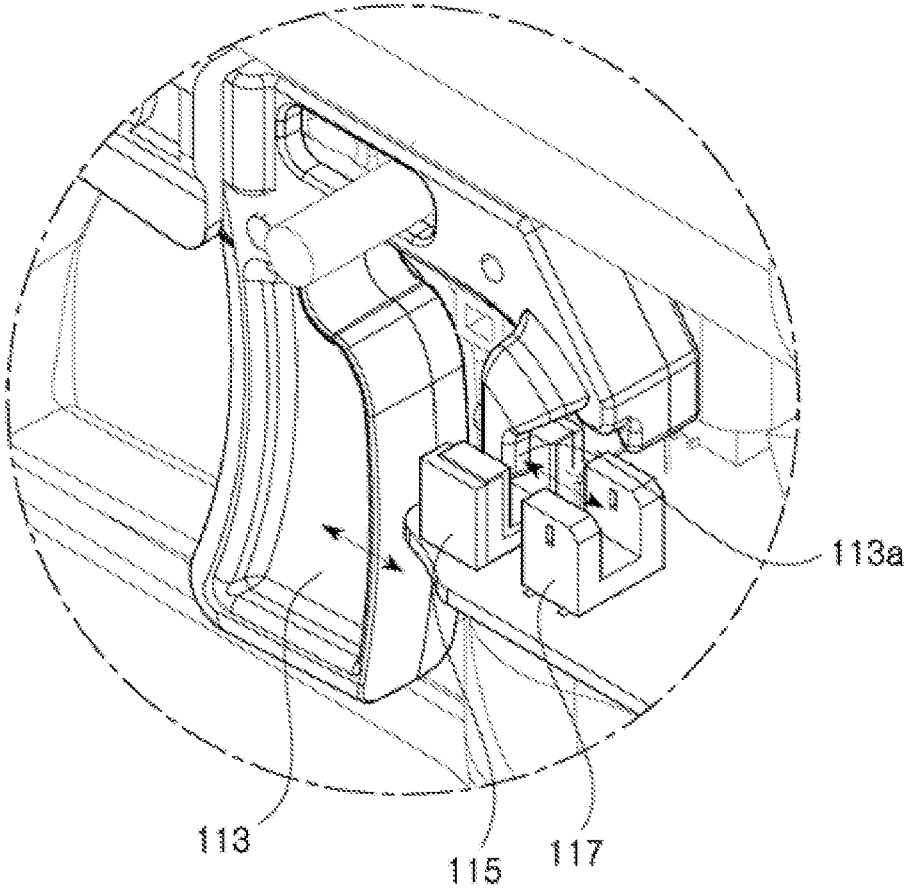
FIG. 4 is a view illustrating operation of the trigger of the smart electroshock device according to one embodiment of the present invention.

FIG. 4 is a view illustrating operation of the trigger of the smart electroshock device according to one embodiment of the present invention.

Now, operation of the trigger 113 of the smart electroshock device 100 will be described with reference to FIG. 4.

Referring to FIG. 4, the trigger 113 is configured as a module. The trigger 113 includes a trigger bar 113*a* disposed on a rear side thereof. The trigger bar 113*a* is moved as the trigger 113 is moved. A first trigger bar detection unit 115 and a second trigger bar detection unit 117 are disposed in the main body 110 to detect the movement of the trigger bar 113*a*. Each of the first trigger bar detection unit 115 and the second trigger bar detection unit 117 consists of a central groove and two upward protrusions flanking the groove. The first trigger bar detection unit 115 and the second trigger bar detection unit 117 may detect whether the trigger bar 113*a* is located inside the respective central grooves or not. Here, each of the first trigger bar detection unit 115 and the second trigger bar detection unit 117 may be a position sensor.

That is, before the trigger 113 is pulled by a user, the trigger bar 113*a* is located inside the first trigger bar detection unit 115. When the trigger 113 has been slightly pulled or is being pulled by the user, the trigger bar 113*a* is located between the first trigger bar detection unit 115 and the second trigger bar detection unit 117, that is, is located outside both the first trigger bar detection unit 115 and the second trigger bar detection unit 117. After the trigger 113 has been fully pulled by the user, the trigger bar 113*a* is located inside the second trigger bar detection unit 117.

In this way, using the first and second trigger bar detection units 115, 117, it is possible to determine which one of the three positions the trigger bar 113*a* is in. When the trigger bar 113*a* is located inside the first trigger bar detection unit 115, the smart electroshock device 100 is not operated. When the trigger bar 113*a* is located between the first trigger bar detection unit 115 and the second trigger bar detection unit 117, that is, when the trigger 113 has been slightly pulled, each of the first laser unit 219 and the second laser unit 221 may be powered on to emit a laser beam.

When the trigger bar 113*a* is located inside the second trigger bar detection unit 117, the projectile 317 may be launched from the smart electroshock device 100 through each of the first muzzle 213 and the second muzzle 215. If the user keeps the trigger 113 pulled such that the trigger bar 113*a* remains located inside the second trigger bar detection unit 117, the cartridge 310 may be continuously supplied with high voltage power.

Figure 5A:
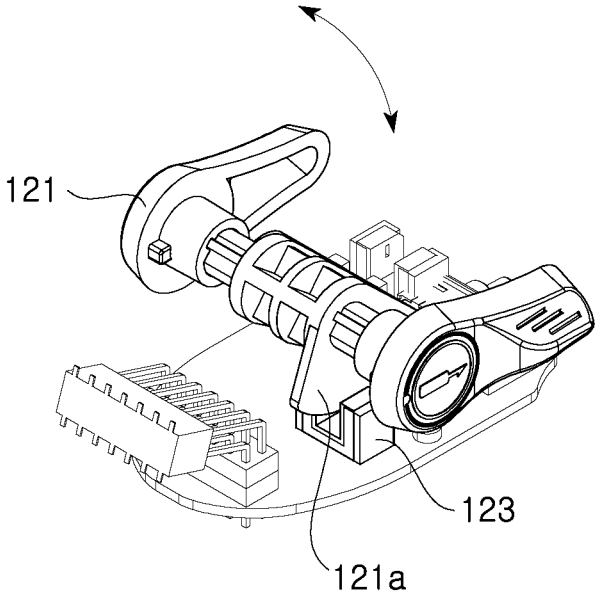
FIG. 5A and FIG. 5B are a view illustrating operation of the safety lever of the smart electroshock device according to one embodiment of the present invention.
Figure 5B:
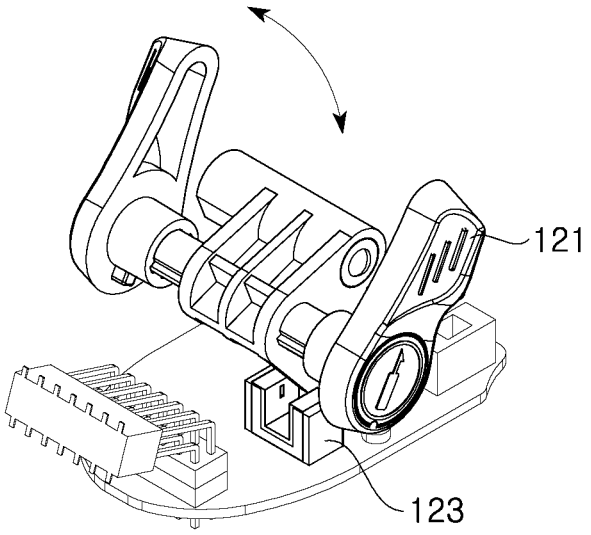

FIG. 5A and FIG. 5B are a view illustrating operation of the safety lever of the smart electroshock device according to one embodiment of the present invention.

Referring to FIG. 5A and FIG. 5B, the safety lever 121 is configured as a module and is rotatable over a predetermined angle. In addition, the safety lever 121 may include a safety lever bar 121*a* formed under a rotating shaft thereof. The safety lever bar 121*a* may have a predetermined area.

In addition, a safety lever bar detection unit 123 may be disposed under the safety lever bar 121*a*. Like the first and second trigger bar detection units 115, 117, the safety lever bar detection unit 123 may consist of a central groove and two upward protrusions flanking the groove. Here, the safety lever bar detection unit 123 may be a position sensor that can detect whether the safety lever bar 121*a* is located inside the groove.

In this embodiment, when the safety lever bar 121*a* is located inside the safety lever bar detection unit 123, the smart electroshock device 100 is powered on, and, when the safety lever bar 121*a* is located outside the safety lever bar detection unit 123, the smart electroshock device 100 is in a safety mode. However, it should be understood that the present invention is not limited thereto and vice versa is possible.

When the smart electroshock device 100 is in the safety mode, the projectile 317 is not launched even if a user pulls the trigger 113, and an electric discharge is not generated by the stun generator 217 even if the user presses the stun button 119.

Figure 6:
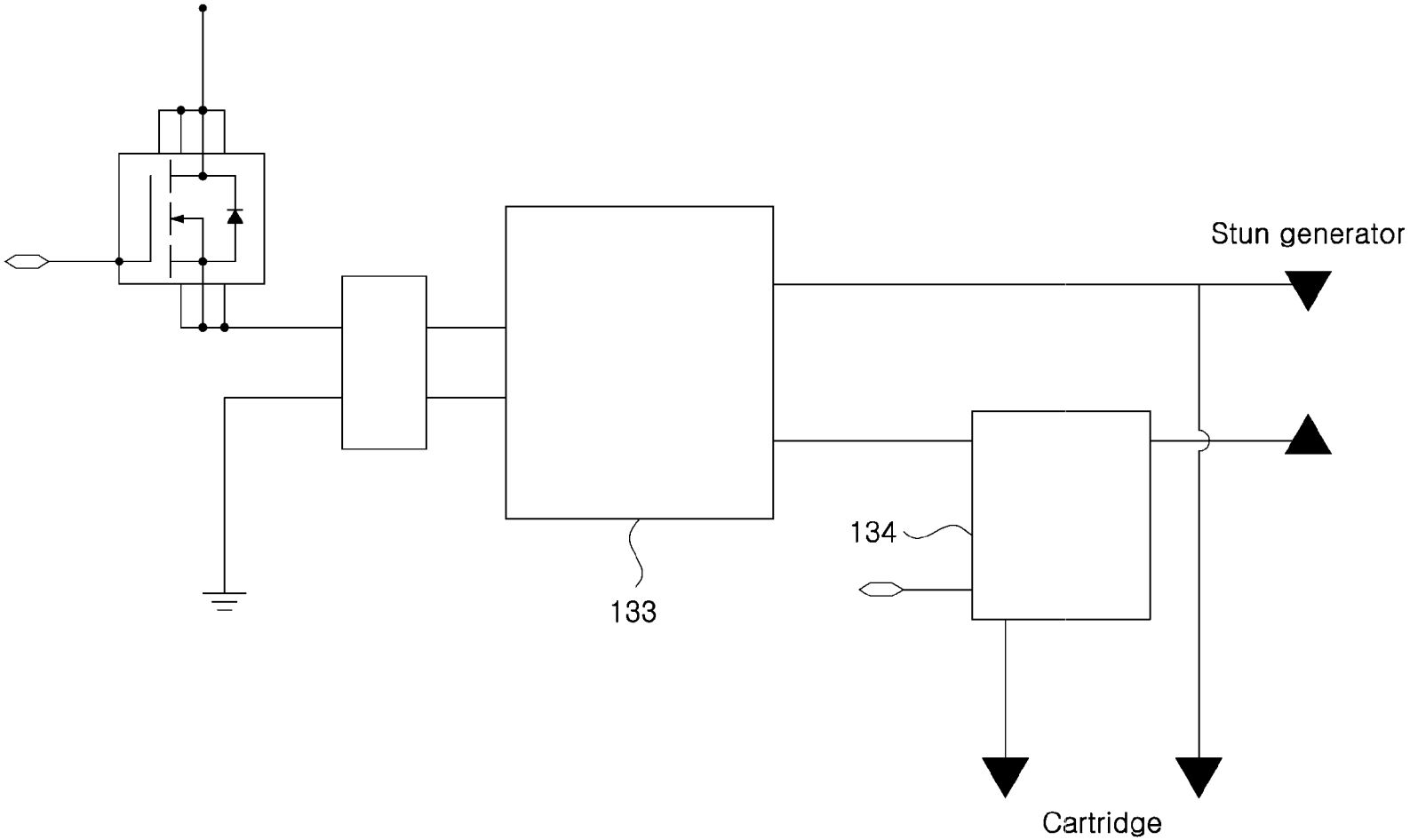
FIG. 6 is a schematic circuit diagram of an output structure of the smart electroshock device according to one embodiment of the present invention and shows a circuit configuration that allows the smart electroshock device to operate as a stun gun without removing the projectile of the cartridge which is in a state to be launched.

FIG. 6 is a schematic circuit diagram of an output structure of the smart electroshock device according to one embodiment of the present invention and shows a circuit configuration that allows the smart electroshock device to operate as a stun gun without removing the projectile of the cartridge which is in a state to be launched.

FIG. 6 is a schematic circuit diagram of the smart electroshock device 100 according to the embodiment of the present invention. Referring to FIG. 6, the high voltage generator 133 outputting high voltage power may be electrically connected to both the stun generator 217 and the cartridge 310. The stun button 119 may act as a switch for discharging the high voltage power generated by the high voltage generator 133 from the stun generator 217. In addition, the trigger 113 may act as a switch for delivering the high voltage power generated by the high voltage generator 133 to the cartridge 310.

With such a separate switch circuit 134 adapted to control the high voltage power from the single high voltage generator 133, the high voltage power can be delivered to the stun generator 217 and the cartridge 310 without any additional action of a user, such as removal of the projectile 317 from the cartridge 310.

Figure 7:
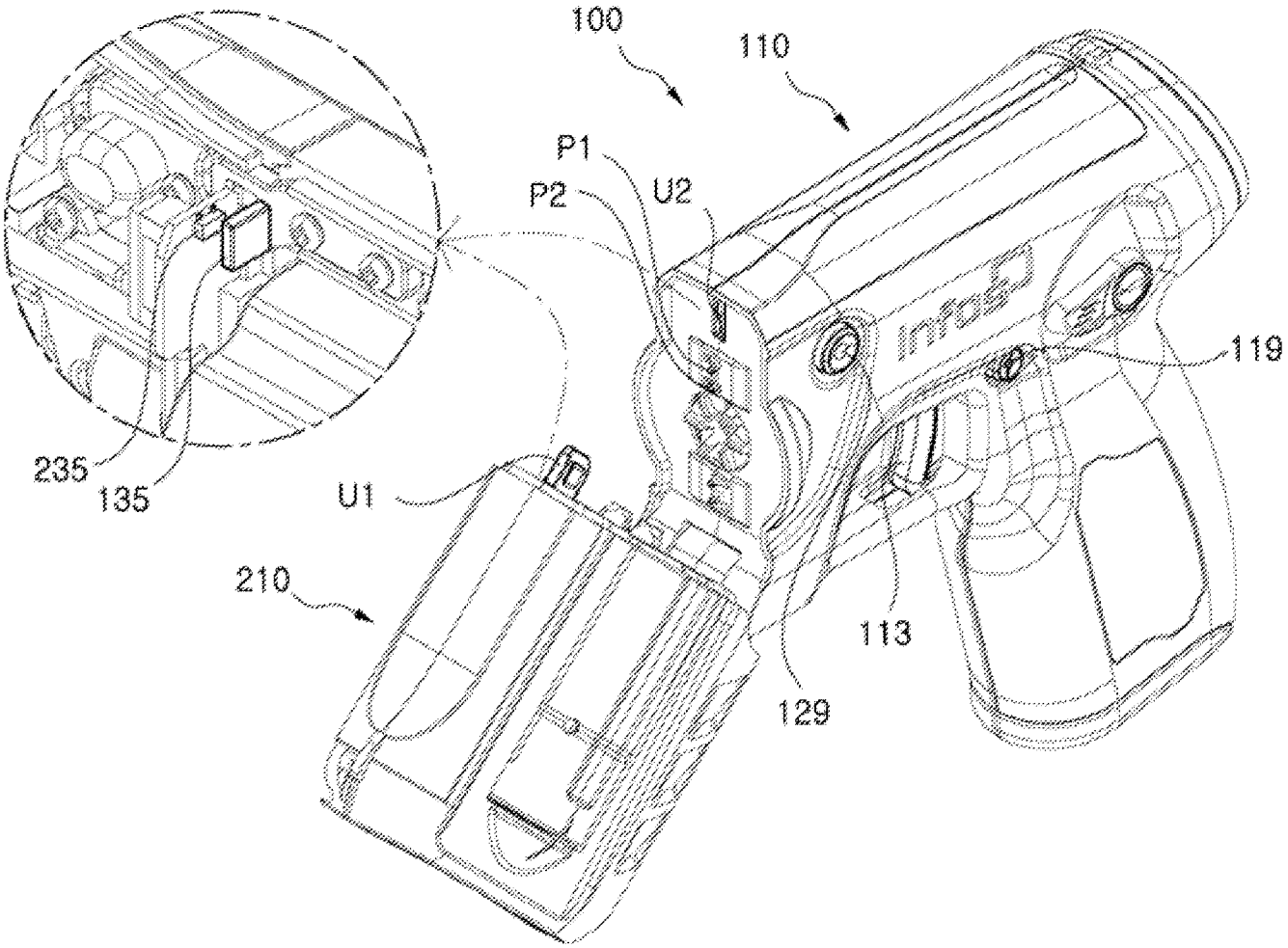
FIG. 7 is a view illustrating a mechanism by which the main body is separated from the cylinder body of the smart electroshock device according to one embodiment of the present invention.

FIG. 7 is a view illustrating a mechanism by which the main body is separated from the cylinder body of the smart electroshock device according to one embodiment of the present invention.

Referring to FIG. 7, the main body 110 and the cylinder body 210 of the smart electroshock device 100 may be separated from one another using the cylinder separation button 129. When a user presses the cylinder separation button 129 with the main body 110 coupled to the cylinder body 210 (see FIG. 1), the cylinder body 210 is separated from the main body 110 to be pivoted downward, as shown in FIG. 2 and FIG. 7.

The cylinder body 210 is formed with a latch U1 and the main body 110 is formed with a catch groove. That is, coupling between the cylinder body 210 and the main body 110 can be achieved by inserting the latch U1 into the catch groove U2 to allow the latch U1 to be locked in the main body 110. When pressed, the cylinder separation button 129 unlocks the latch U1 from the catch groove U2.

With the cylinder body 210 separated from the main body 110, the smart electroshock device 100 needs to be disabled. If high voltage power is delivered to a first electrode P1 and a second electrode P2 adapted to power the cartridge 310 when the trigger 113 is pulled with the cylinder body 210 separated from the main body 110, there is a risk that an electric discharge will be generated between the first electrode P1 and the second electrode P2. In addition, if high voltage power is delivered to the stun generator 217 disposed on the front side of the cylinder body 210 when the stun button 119 is pressed with the cylinder body 210 separated from the main body 110, there is a risk that an electric discharge will be generated by the stun generator 217. In other words, if the smart electroshock device 100 is operated with the cylinder body 210 separated from the main body 110, there is a risk that a user handling the smart electroshock device 100 will be shocked by electricity.

According to this embodiment, a magnet 135 and a magnetic detection unit 235 are further provided to the smart electroshock device 100. Specifically, the magnet 135 is disposed in the cylinder body 210 and the magnetic detection unit 235 is disposed in the main body 110. Accordingly, when the cylinder body 210 is coupled to the main body 110, the magnetic detection unit 235 can detect a magnetic field from the magnet 135. When the magnetic field from the magnet 135 is detected by the magnetic detection unit 235, the smart electroshock device 100 is operated normally.

When the magnetic field from the magnet 135 is not detected by the magnetic detection unit 235, all functions of the smart electroshock device 100 may be shut down without separately manipulating the safety lever 121. That is, when the cylinder body 210 is separated from the main body 110 and the magnetic field from the magnet 135 is thus not detected by the magnetic detection unit 235, the smart electroshock device 100 can be disabled as in the case when the safety lever 121 is in the safety mode.

Figure 8:
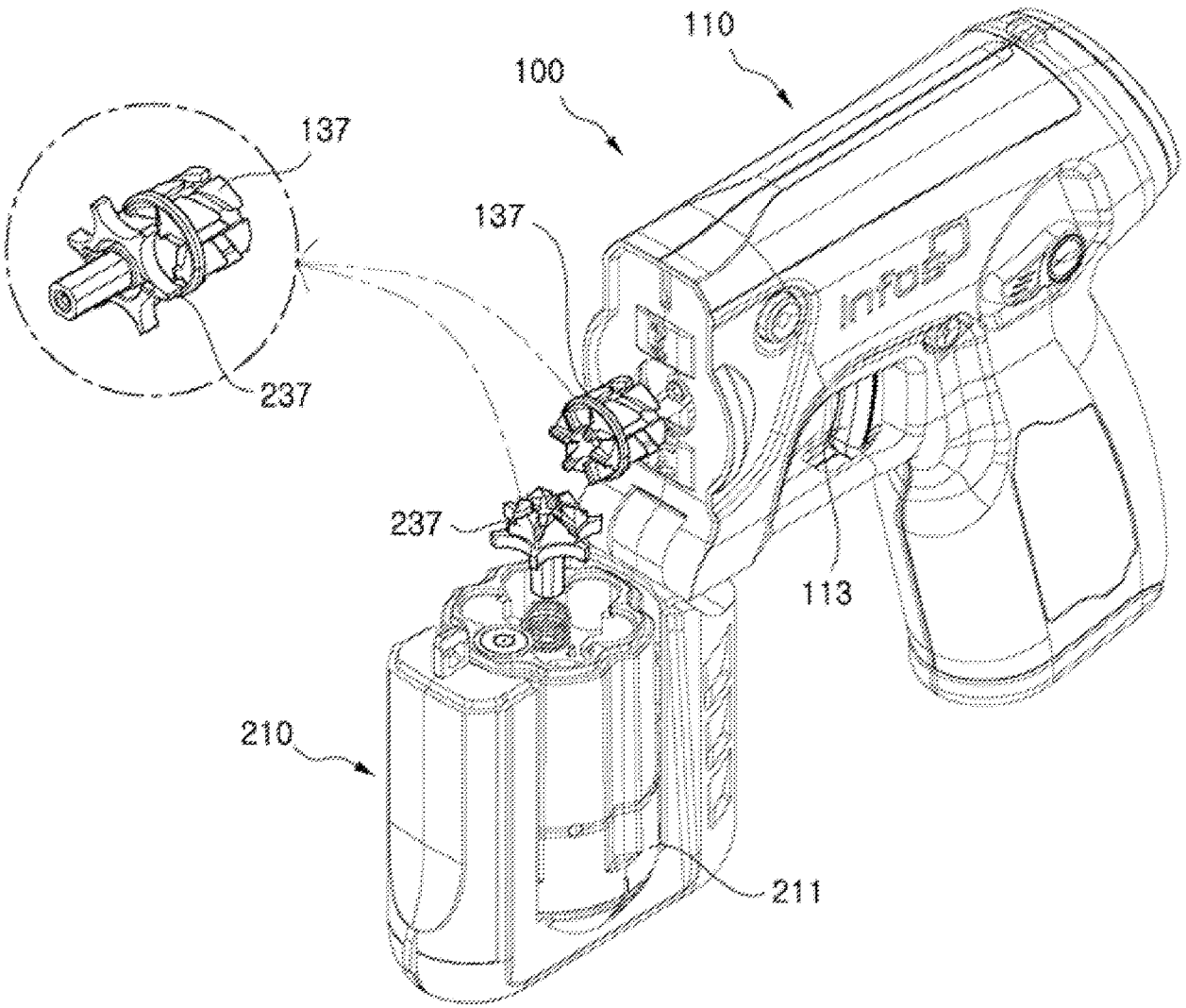
FIG. 8 is a view illustrating operation of the cylinder induced by operation of the trigger of the smart electroshock device according to one embodiment of the present invention.

FIG. 8 is a view illustrating operation of the cylinder induced by operation of the trigger of the smart electroshock device according to one embodiment of the present invention.

In the smart electroshock device 100 according to this embodiment, after a user pulls the trigger 113 to launch the projectile 317, the cylinder 211 is rotated by a predetermined angle. As a result, the user can launch the projectile 317 consecutively. In this embodiment, since the cylinder 211 is formed with six cartridge insertion holes 211*a*, launch of the projectile 317 can be performed three times in succession.

The smart electroshock device 100 includes a coupler base 137 and a coupler revolver 237 such that the cylinder 211 can be rotated by operation of the trigger 113. The coupler base 137 is disposed in the main body 110 and the coupler revolver 237 is disposed in the cylinder body 210. Specifically, the coupler revolver 237 is disposed on a rotating shaft of the cylinder 211.

Referring to FIG. 8, with the cylinder body 210 coupled to the main body 110, the coupler base 137 is connected to the coupler revolver 237 such that one surface of the coupler base 137 is held against one surface of the coupler revolver 237. The coupler base 137 and the coupler revolver 237 connected to one another can be rotated in one direction by operation of the trigger 113. In this embodiment, the cylinder 211 is rotated in only one direction when a user releases the trigger 113 after pulling the trigger. That is, when the user is pulling the trigger 113 or when the user keeps the trigger pulled, the coupler base 137 and the coupler revolver 237 are not rotated, and, when the user releases the trigger 113 to return the trigger to the original position thereof, the coupler base 137 and the coupler revolver 237 are rotated in one direction.

Figure 9:
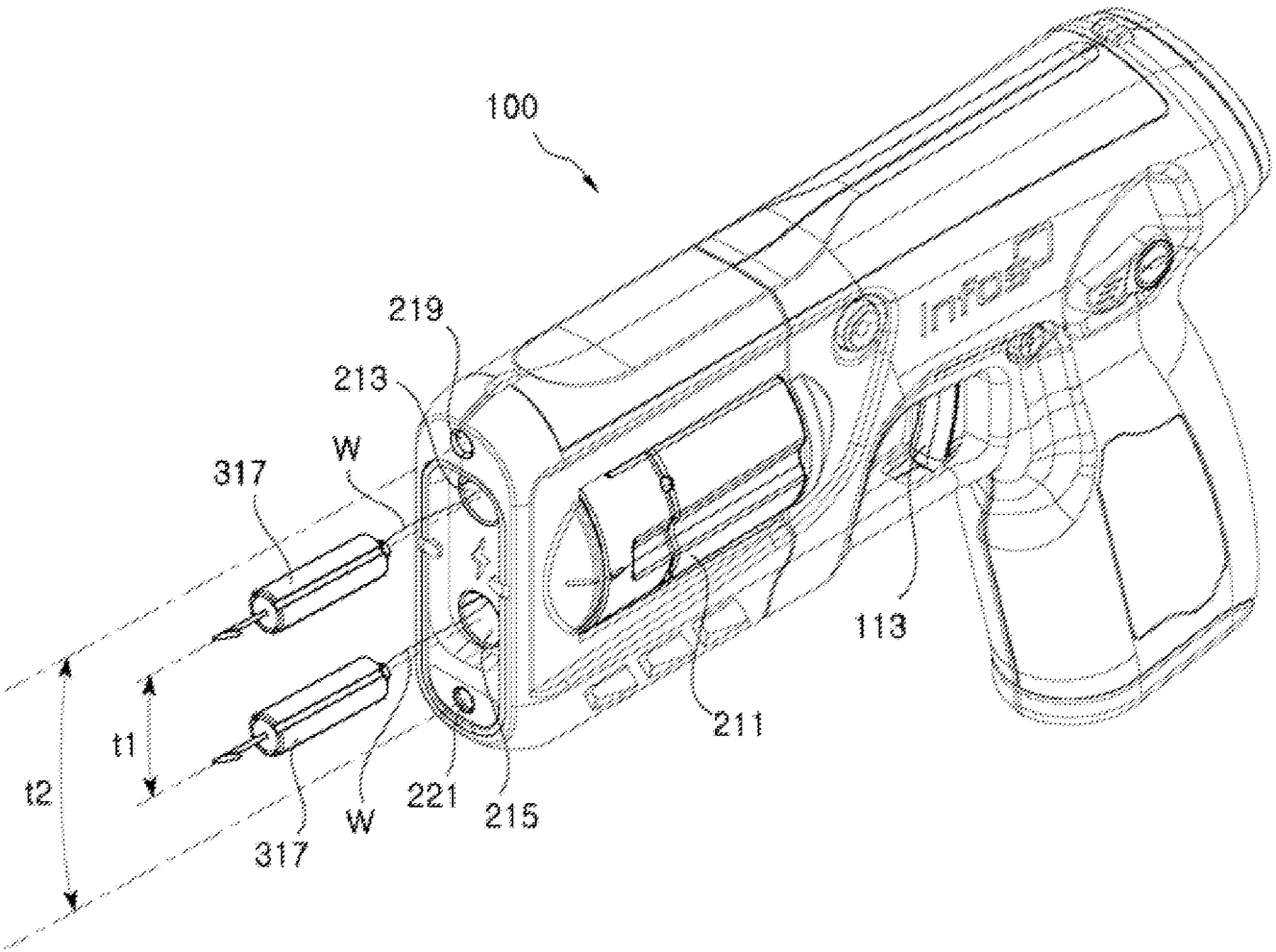
FIG. 9 is a view illustrating launch of the projectile from the smart electroshock device according to one embodiment of the present invention.

FIG. 9 is a view illustrating launch of the projectile from the smart electroshock device according to one embodiment of the present invention.

In this embodiment, two projectiles 317 may be launched toward a target from the smart electroshock device 100 through the first muzzle 213 and the second muzzle 215, respectively. Although the two projectiles 317 may be launched parallel to one another from the smart electroshock device 100, in this embodiment, the two projectiles 317 may be launched at angles of t1 (e.g., 4 degrees) to one another. Accordingly, the distance between the two projectiles 317 gradually increases as distance from the smart electroshock device increases.

In addition, like the two projectiles 317 simultaneously launched from the smart electroshock device, two laser beams may be launched at angles of t2 (e.g., 4 degrees) to one another from the first laser unit 219 and the second laser unit 221, respectively. Accordingly, the two projectiles 317 may be launched toward points of a target at which the two laser beams from the first laser unit 219 and the second laser unit 221 are pointed, respectively.

In this embodiment, one projectile 317 launched through the first muzzle 213 may have a launch angle of t½ (e.g., 2 degrees) in an upward direction with respect to a virtual horizontal line and the other projectile 317 launched through the second muzzle 215 may have a launch angle of t½ (e.g., 2 degrees) in a downward direction with respect to the virtual horizontal line.

Likewise, the cylinder 211 is rotated in one direction about a rotation axis thereof, wherein the rotation axis may correspond to the virtual horizontal line. That is, the virtual horizontal line may be a line extending from the rotation axis of the cylinder 211. Accordingly, each of the cartridge insertion holes 211*a* of the cylinder 211 may extend at an angle of t½ (e.g., 2 degrees) with respect to the rotation axis of the cylinder 211.

Figure 10A:
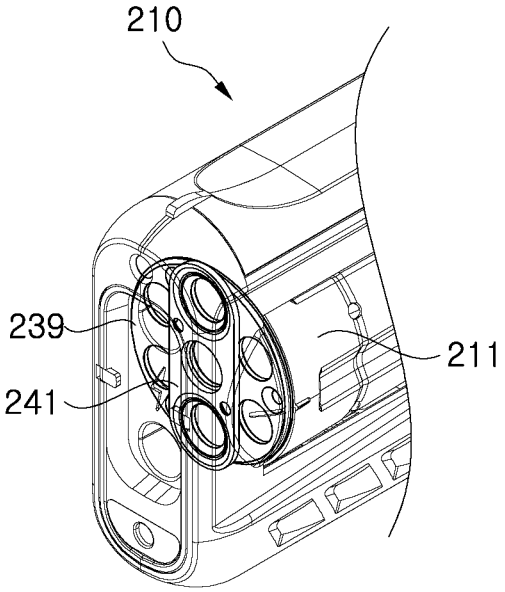
FIG. 10A to FIG. 10C are a view illustrating a mechanism for cutting a wire W connected to the projectile of the smart electroshock device according to one embodiment of the present invention.
Figure 10B:
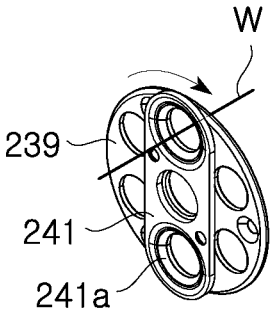
Figure 10C:
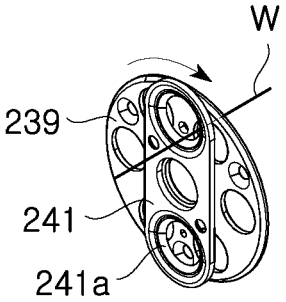

FIG. 10A to FIG. 10C are a view illustrating a mechanism for cutting a wire W connected to the projectile of the smart electroshock device according to one embodiment of the present invention.

As shown in FIG. 9, the projectile 317 launched from the smart electroshock device 100 is connected to the smart electroshock device 100 via a wire W. Accordingly, high voltage power can be delivered to the projectile 317 stuck in a target from the smart electroshock device 100.

In order to launch the next projectile, it is necessary to cut the wire W connected to the already-launched projectile 317.

As described above with reference to FIG. 8, while the trigger 113 having been pulled is returning to the original position thereof, the cylinder 211 is rotated by a predetermined angle in one direction, which can be utilized to cut the wire W.

Referring to FIG. 10A, a blade rotor 239 may be disposed in front of the cylinder 211 to cut the wire W and a blade base 241 may be disposed in front of the blade rotor 239 such that one surface thereof is held against the blade rotor 239.

The blade rotor 239 may be formed with a plurality of holes corresponding to the plurality of the cartridge insertion holes 211*a* of the cylinder 211 and may corotate with the cylinder 211.

The blade base 241 may be disposed at the rear of the first muzzle 213 and the second muzzle 215 of the cylinder body 210 and may be formed with two holes corresponding to the first muzzle 213 and the second muzzle 215. In addition, the blade base 241 may remain secured to the cylinder body 210 without being rotated when the cylinder 211 is rotated.

After being launched from the cartridge 310 disposed in each of the cartridge insertion holes 211*a* of the cylinder 211, the projectile 317 passes through a corresponding one of the holes of the blade rotor 239 and a corresponding one of the holes of the blade base 241. After the projectile 317 is launched, the wire W connected between the projectile 317 and the smart electroshock device 100 also passes through the corresponding hole of the blade rotor 239 and the corresponding hole of the blade base 241, as shown in FIG. 10B.

After the wire W passes through the corresponding hole of the blade rotor 239 and the corresponding hole of the blade base 241, the blade rotor 239 may be rotated through rotation of the cylinder 211 such that the corresponding hole of the blade rotor 239 can be out of line with the corresponding hole of the blade base 241. As a result, the wire W passing through the corresponding hole of the blade rotor 239 and the corresponding hole of the blade base 241 can be cut.

Each of the holes of the blade base 241 may have an inclined surface 241*a*, as shown in FIG. 10B and FIG. 10C. With the inclined surface 241*a* of each of the holes of the blade base 241, the blade rotor 239 and the blade base 241 can act like a pair of scissors to cut the wire W.

Figure 11:
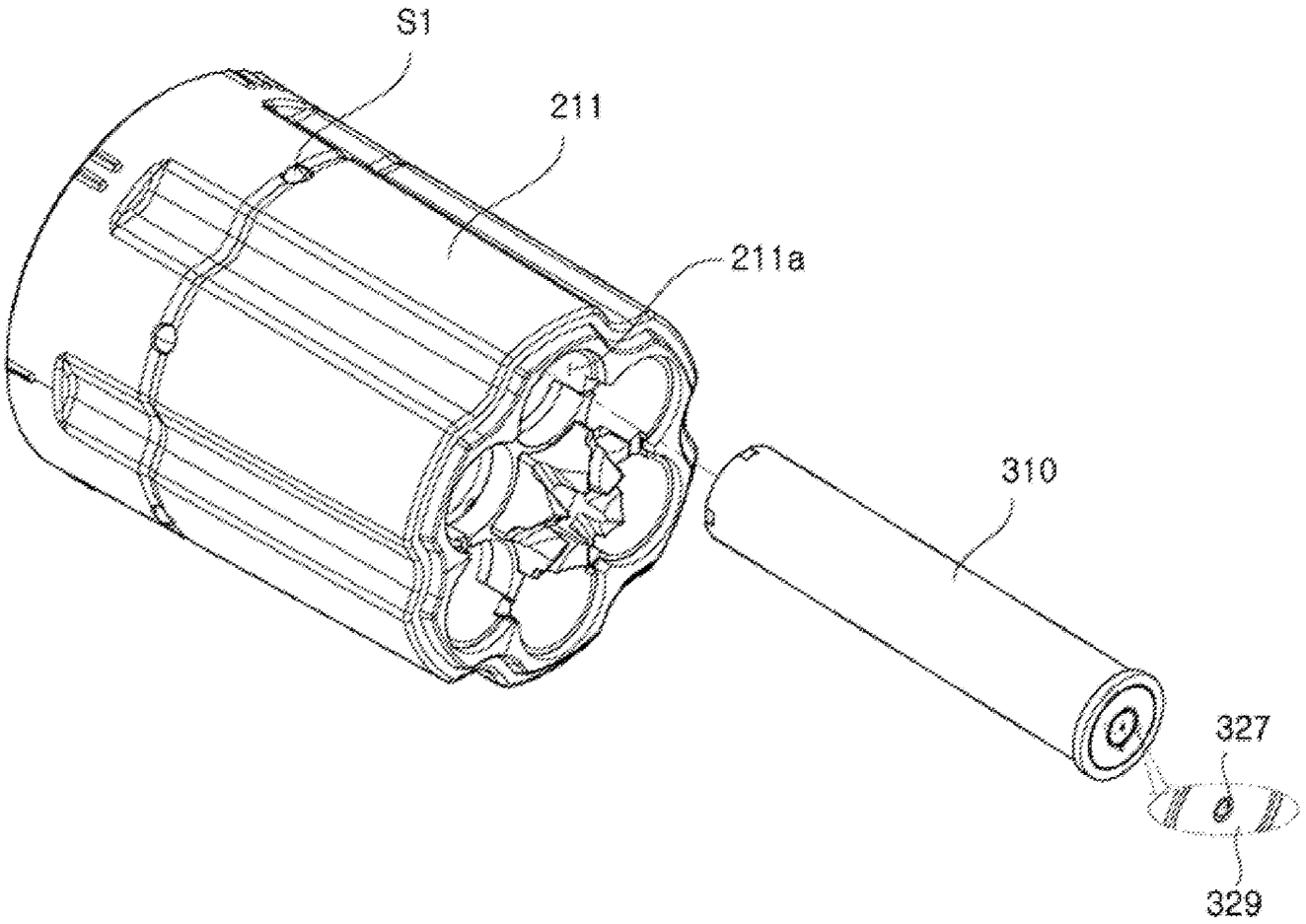
FIG. 11 is a view illustrating mounting of the cartridge in the cylinder of the smart electroshock device according to one embodiment of the present invention.
Figure 12:
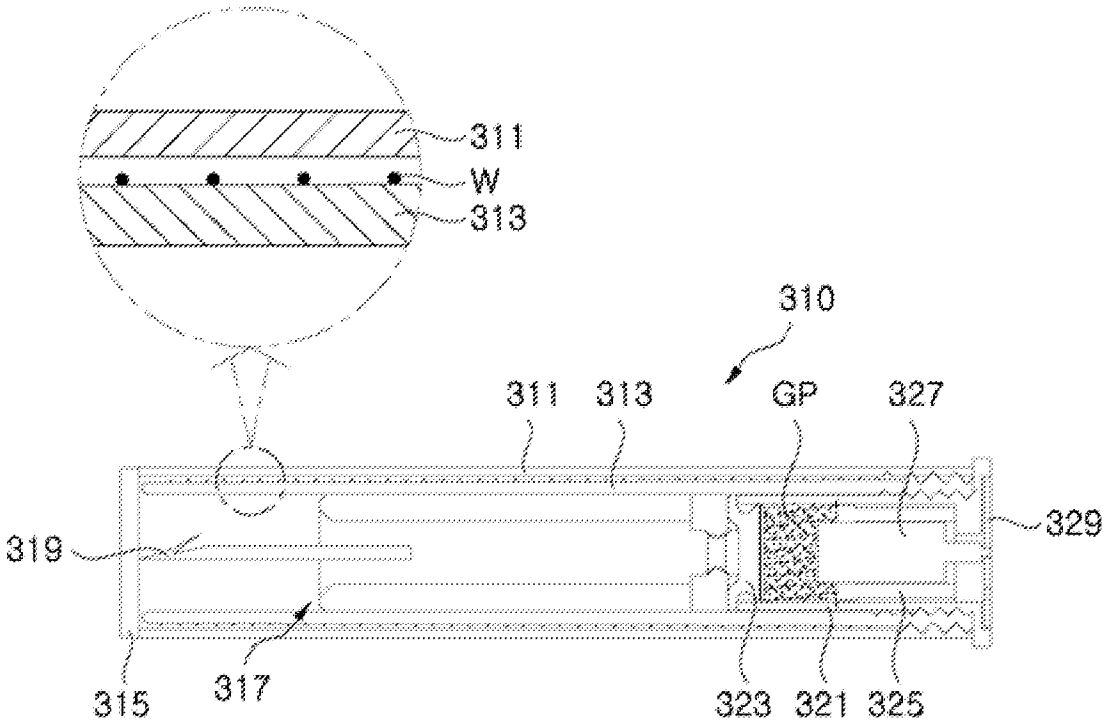
FIG. 12 is a sectional view of the cartridge of the smart electroshock device according to one embodiment of the present invention.

FIG. 11 is a view illustrating mounting of the cartridge in the cylinder of the smart electroshock device according to one embodiment of the present invention. FIG. 12 is a sectional view of the cartridge of the smart electroshock device according to one embodiment of the present invention and FIG. 13 is an exploded perspective view of the cartridge of the smart electroshock device according to the embodiment.

As described above, the cylinder 211 of the smart electroshock device 100 according to this embodiment is formed with six cartridge insertion holes 211*a*. In addition, the cylinder 211 may include a first contact portion S1 partially protruding from an outer surface thereof. Details of the first contact portion S1 will be described further below.

Figure 13:
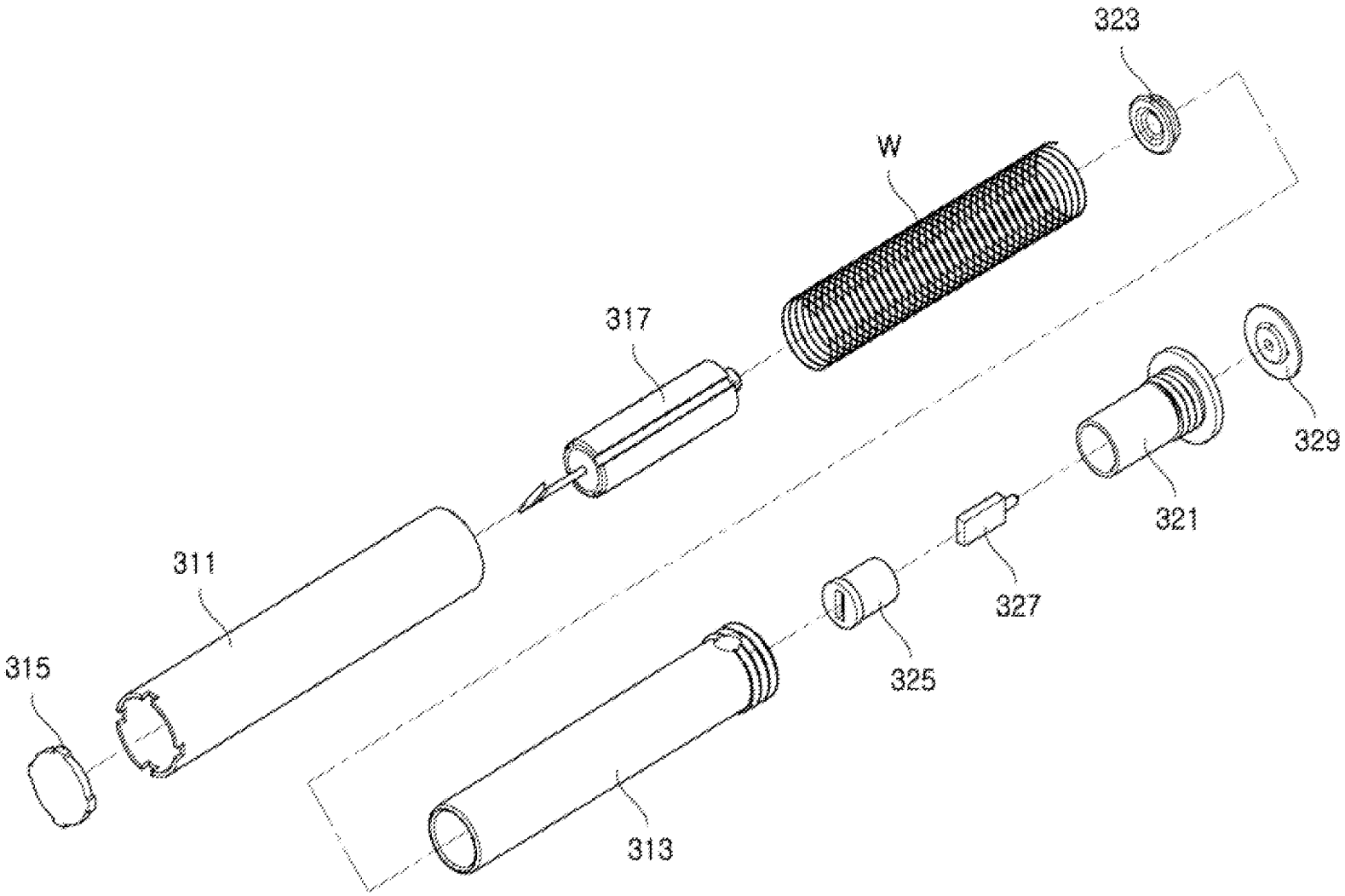
FIG. 13 is an exploded perspective view of the cartridge of the smart electroshock device according to the embodiment.

Referring to FIG. 11 to FIG. 13, the cartridge 310 includes an outer case 311, an inner case 313, a front cover 315, the projectile 317, a detonator case 321, a wad 323, a detonator holder 325, a detonator 327, and an electrode pad 329.

The outer case 311 is open at both ends thereof, is hollow, is connected at one end thereof to the front cover 315, and is connected at the other end thereof to the detonator case 321. Here, the front cover 315 may be fitted into the outer case 311. The outer case 311 may be formed of an electrically conductive material such as a metal.

The inner case 313 may be disposed inside the outer case 311 and may have a wire W wound around an outer circumferential surface thereof. One end of the wire W wound around the inner case 313 may be electrically connected to the outer case 311.

Like the outer case 311, the inner case 313 may be open at both ends thereof and may be hollow. The inner case 313 may be coupled to the outer case 311 through screw fastening, and the detonator case 321 may be coupled to the inner case 313 through screw fastening at a junction between the inner case 313 and the outer case 311. Here, the detonator case 321 may be coupled to the inner case 313 such that a greater part of the detonator case 321 is located inside the inner case 313 and one end of the detonator case 321 covers one open end of the outer case 311.

Although the inner case 313 may be formed of an electrically conductive material, like the outer case 311, it should be understood that the present invention is not limited thereto and the inner case may be formed of an electrically nonconductive material.

The projectile 317 may be disposed inside the inner case 313 and may include an electrode needle 319 formed at one end thereof. A free end of the electrode needle 319 may be sharpened to stick in a target.

The projectile 317, including the electrode needle 319, may be formed of an electrically conductive material such as a metal. In addition, the other end of the projectile 317 may be connected to the wire W. Accordingly, the projectile 317 can be electrically connected to the outer case 311 via the wire W. As a result, high voltage power applied to the outer case 311 can be delivered to the electrode needle 319 of the projectile 317 through the wire W.

When launched, the projectile 317 can push the front cover 315 off the outer case 311.

The wad 323 may be disposed at the rear of the projectile 317 to cover one end of the detonator case 321. Here, the other end of the detonator case 321 may cover the outer case 311 and the one end of the detonator case may be open such that the detonator case can have an accommodation space. The wad 323 may be adapted to cover the open end of the detonator case 321.

The detonator holder 325 and the detonator 327 may be disposed inside the detonator case 321. The detonator holder 325 may have an internal space to receive the detonator 327 and may electrically contact the detonator case 321. The detonator 327 is disposed inside the detonator holder 325, wherein one end of the detonator 327 may protrude outside the detonator holder 325 and the other end of the detonator 327 may be exposed outside the cartridge 310 through the detonator holder 325 and the detonator case 321. Here, the other end of the detonator 327 exposed outside the cartridge 310 through the detonator holder 325 and the detonator case 321 may be separated and electrically insulated from the detonator holder 325 and the detonator case 321. In addition, the one end of the detonator 327 protruding outside the detonator holder 325 may electrically contact the detonator holder 325.

The detonator case 321 contains a predetermined gunpowder GP. Since the wad 323 covers the open end of the detonator case 321, the gunpowder GP can be prevented from being discharged from the detonator case 321.

The electrode pad 329 is disposed at the other end of the detonator case 321 to cover a greater part of the rear side of the cartridge 310. In addition, the electrode pad 329 may electrically contact the detonator case 321.

Figure 14:
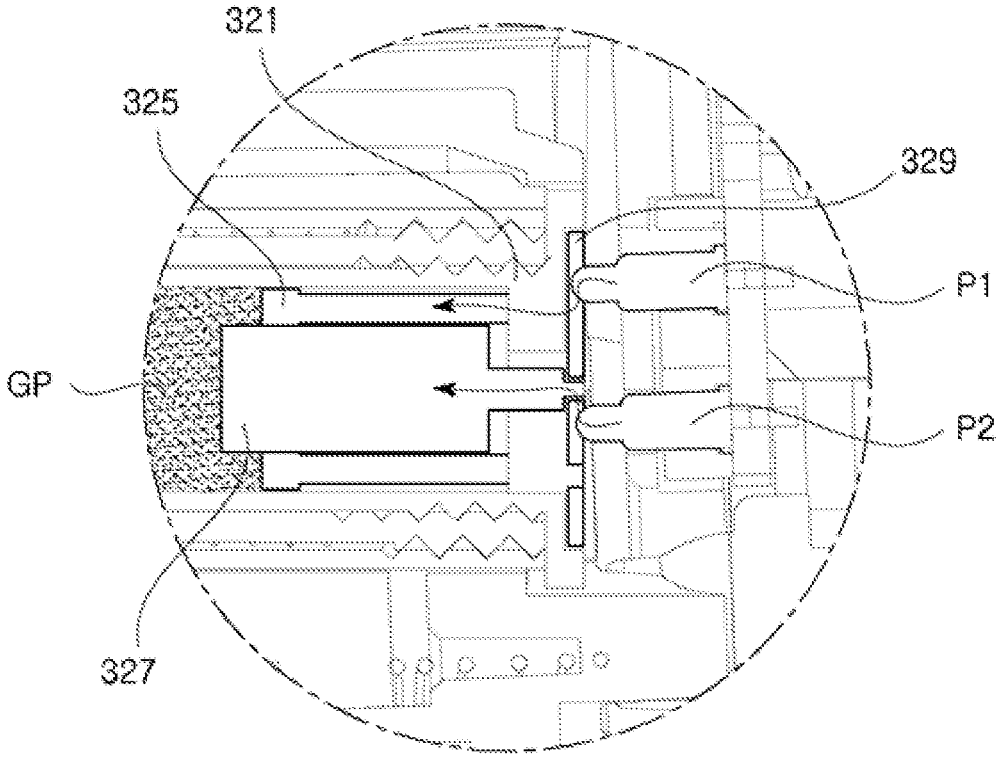
FIG. 14 is a view illustrating a mechanism for delivering electric power to the cartridge of the smart electroshock device according to one embodiment of the present invention.

FIG. 14 is a view illustrating a mechanism for delivering electric power to the cartridge of the smart electroshock device according to one embodiment of the present invention.

In order to launch the projectile 317 from the smart electroshock device 100, it is necessary to send electric signals to the cartridge 310. For this purpose, the smart electroshock device includes a first electrode P1 and a second electrode P2 electrically connected to the circuit unit 132 disposed in the main body 110. The first electrode P1 contacts the electrode pad 329 to transmit an electric signal to the detonator holder 325 via the detonator case 321. The second electrode P2 transmits an electric signal to the detonator 327 via the electrode pad 329. As the electric signals are transmitted to the detonator holder 325 and the detonator 327, respectively, power is applied to the detonator 327, such that the gunpowder GP in contact with the detonator 327 can explode.

Although not shown in the drawings, as the gunpowder GP explodes, the wad 323 is pushed toward the open end of the inner case 313 to push the projectile 317, whereby the projectile 317 can be launched from the smart electroshock device 100.

Figure 15:
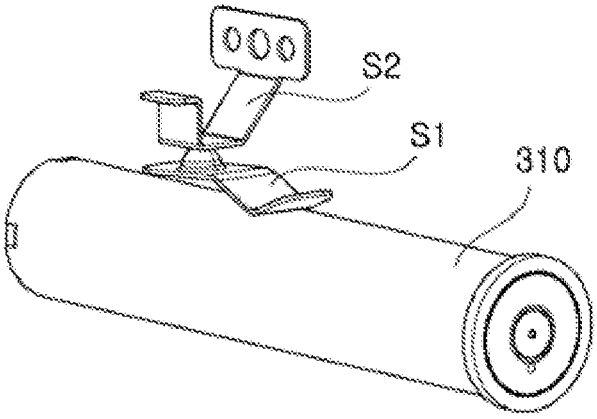
FIG. 15 is a view illustrating a mechanism by which electric power is delivered to the cartridge of the smart electroshock device according to one embodiment of the present invention.
Figure 16:
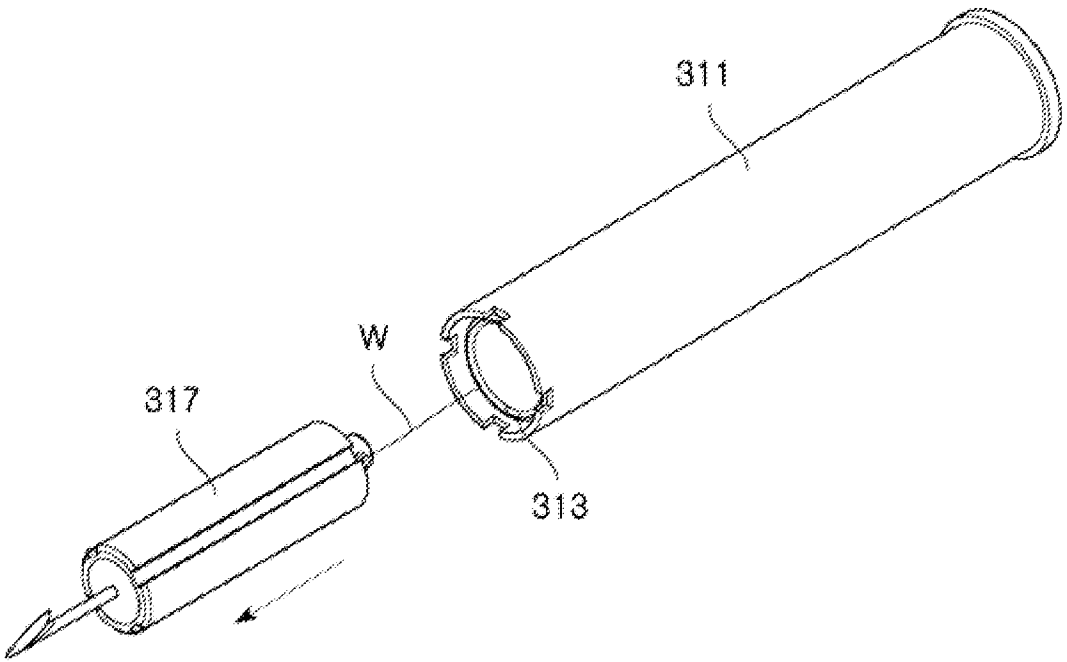
FIG. 16 is a view illustrating launch of the projectile from the cartridge of the smart electroshock device according to one embodiment of the present invention.

FIG. 15 is a view illustrating a mechanism by which electric power is delivered to the cartridge of the smart electroshock device according to one embodiment of the present invention and FIG. 16 is a view illustrating launch of the projectile from the cartridge of the smart electroshock device according to one embodiment of the present invention.

Referring to FIG. 16, when the projectile 317 is launched from the cartridge 310, the wire W connected between the projectile 317 and the outer case 311 is released from the outer surface of the inner case 313. In this way, with the wire W, the projectile 317 can remain electrically connected to the outer case 311. As described with respect to FIG. 14, in order to launch the projectile 317, electric signals are sent to the first electrode P1 and the second electrode P2. After the projectile 317 is launched, high voltage power is delivered to the projectile 317 through the outer case 311.

Referring to FIG. 15, the smart electroshock device includes a first contact S1 and a second contact S2 to supply high voltage power to the outer case 311 of the cartridge 310. One end of the first contact S1 contacts the outer surface of the outer case 311 and the other end of the first contact contacts S1 the second contact S2. Accordingly, the high voltage power supplied to the second contact S2 can be delivered to the outer case 311 through the first contact S1.

The first contact S1 may be disposed in the cylinder 211 such that a portion of the other end of the first contact S1 contacting the second contact S2 is exposed outside the cylinder 211. Although not shown in the drawings, the one end of the first contact S1 contacting the outer case 311 of the cartridge 310 may protrude from an inner wall of each of the cartridge insertion holes 211*a* of the cylinder 211. Since the first contact S1 is provided to each of the cartridge insertion holes 211*a* of the cylinder 211, a total of 6 first contacts may be disposed in the cylinder 211 including six cartridge insertion holes 211*a*.

The second contact S2 is disposed in the cylinder body 210 to be electrically connected to the high voltage generator disposed in the main body 110. The second contact S2 may include a pair of second contacts disposed above and below the cylinder 211, respectively, wherein the pair of second contacts is secured to the cylinder body 210. Accordingly, the second contact S2 may be brought into contact with or separated from the first contact S1 as the cylinder 211 is rotated.

In this embodiment, each of the first contact S1 and the second contact S2 may be provided in the form of a leaf spring.

Although some embodiments have been described herein, it should be understood that these embodiments are provided for illustration only and are not to be construed in any way as limiting the present invention, and that various modifications, changes, alterations, and equivalent embodiments can be made by those skilled in the art without departing from the spirit and scope of the invention. The scope of the present invention should be defined by the appended claims and equivalents thereof.

What is claimed is:

1. A smart electroshock device comprising:

a main body provided therein with electronic components to launch a projectile, the projectile being adapted to be stuck in a target and apply an electric shock to the target;

a cylinder body coupled to one side of the main body via a hinge and comprising a cylinder; and a plurality of cartridges mounted in the cylinder and each comprising the projectile, wherein the projectile is launched from the cylinder through manipulation of the main body, and the cylinder is rotatably coupled to the cylinder body, wherein, after being launched, the projectile is supplied with high voltage power from the main body via a wire connected to the projectile through a muzzle formed in the cylinder body, and the smart electroshock device further comprises: a blade rotor disposed in front of the cylinder to cut the wire, and a blade base is disposed in front of the blade rotor to cut the wire in cooperation with the blade rotor when the blade rotor is rotated.

2. The smart electroshock device according to claim 1, wherein the main body comprises:

a trigger operated to launch the projectile;

a high voltage generator supplying high voltage power to the projectile to launch the projectile; and a power source supplying power to the high voltage generator.

3. The smart electroshock device according to claim 2, wherein the main body further comprises:

a display portion coupled to the main body to display operation status of a circuit and operation state and amount of charge in a battery and to control functions of the smart electroshock device.

4. The smart electroshock device according to claim 2, wherein the trigger comprises a trigger bar formed at one side of the trigger, and the smart electroshock device further comprises at least one trigger bar detection unit detecting movement of the trigger bar.

5. The smart electroshock device according to claim 4, further comprising:

a plurality of laser units emitting a laser beam toward a point of the target in which the projectile will be stuck, wherein the at least one trigger bar detection unit comprises a first trigger bar detection unit and a second trigger bar detection unit, and each of the plurality of the laser units emits a laser beam when the trigger bar is not detected by the first trigger bar detection unit and the second trigger bar detection unit.

6. The smart electroshock device according to claim 5, wherein, when the first trigger bar detection unit detects the trigger bar, the projectile is not launched, and, when the second trigger bar detection unit detects the trigger bar, the projectile is launched.

7. The smart electroshock device according to claim 5, further comprising:

a display portion coupled to the main body, wherein whether to operate the plurality of laser units is controlled through manipulation of the display portion.

8. The smart electroshock device according to claim 1, further comprising:

a flash disposed on a front side of the cylinder body to emit light in a launch direction of the projectile.

9. The smart electroshock device according to claim 2, wherein the power source is a battery, the battery comprising an indicator showing an amount of charge in the battery and an indicator control button activating the indicator.

10. The smart electroshock device according to claim 2, further comprising:

a stun generator disposed on a front side of the cylinder body to discharge high voltage electricity supplied from the high voltage generator.

11. The smart electroshock device according to claim 10, wherein the main body further comprises a stun button for discharging high voltage electricity from the stun generator.

12. The smart electroshock device according to claim 10, further comprising:

a switch circuit disposed in the main body and electrically connected to the high voltage generator to apply high voltage to the plurality of cartridges or the stun generator.

13. The smart electroshock device according to claim 1, further comprising:

a safety lever disposed in the main body to shut off power to the projectile such that the projectile is not launched, the safety lever comprising a safety lever bar formed at one side thereof; and a safety lever bar detection unit detecting the safety lever bar.

14. The smart electroshock device according to claim 13, wherein the safety lever is rotatable and the safety lever bar detection unit detects the safety lever bar corotating with the safety lever.

15. The smart electroshock device according to claim 1, wherein the cylinder body is formed with a latch for coupling the cylinder body to the main body; the main body is formed with a catch groove allowing the latch to be caught therein; and the smart electroshock device further comprises a cylinder separation button disposed in the main body to unlock the latch to separate the cylinder body from the main body.

16. The smart electroshock device according to claim 15, wherein the cylinder body is pivotable about the hinge when separated from the main body.

17. The smart electroshock device according to claim 1, further comprising:

a magnet disposed in any one of the cylinder body and the main body; and a magnetic detection unit disposed in the other of the cylinder body and the main body to detect a magnetic field from the magnet, wherein, when the magnetic field from the magnet is not detected by the magnetic detection unit, power to the projectile is shut off such that the projectile is not launched.

18. The smart electroshock device according to claim 2, further comprising:

a coupler base disposed in the main body to rotate the cylinder; and a coupler revolver rotating the cylinder through rotation of the coupler base.

19. The smart electroshock device according to claim 18, wherein the coupler base is not rotated during operation to launch the projectile and is rotated while the trigger is returned to an original position thereof to move the next projectile mounted in the cylinder to a launch position.

20. The smart electroshock device according to claim 1, wherein the smart electroshock device simultaneously launches two projectiles from the cylinder, the two projectiles being launched at predetermined angles to one another.

21. The smart electroshock device according to claim 5, wherein the plurality of laser units comprises two laser units and a laser beam from one laser unit forms a predetermined angle with a laser beam from the other laser unit.

22. The smart electroshock device according to claim 1, wherein the blade rotor corotates with the cylinder.

23. The smart electroshock device according to claim 20, wherein the blade base is formed with a hole through which the wire passes, the hole having an inclined surface.

24. The smart electroshock device according to claim 1, wherein the cartridge comprises:

the projectile including an electrode needle formed at one end thereof to be stuck in the target;

an inner case receiving the projectile;

a wire connected to the projectile and wound around an outer circumferential surface of the inner case;

an outer case open at one end thereof to allow the projectile to be launched therethrough, receiving the inner case, and electrically connected to the wire;

a detonator case sealing the other end of the outer case; and a detonator disposed inside the detonator case to launch the projectile.

25. The smart electroshock device according to claim 24, wherein the detonator case is open at one end thereof and has an accommodation space therein, and the cartridge further comprises: a detonator holder disposed inside the detonator case and receiving the detonator; a wad covering the open end of the detonator case; and an electrode pad disposed outside the detonator case to transmit electric power to the detonator.

26. The smart electroshock device according to claim 24, wherein the cartridge further comprises a cover covering the open end of the outer case.

27. The smart electroshock device according to claim 25, further comprising:

a plurality of electrodes disposed in the main body and contacting the electrode pad to transmit electric signals for launching the projectile to the detonator through the electrode pad.

28. The smart electroshock device according to claim 27, wherein one of the plurality of electrodes transmits an electric signal to the detonator holder through the detonator case and another one transmits an electric signal to the detonator.

29. The smart electroshock device according to claim 24, further comprising:

a first contact disposed in the cylinder such that one end thereof is exposed inside a cartridge insertion hole formed in the cylinder and receiving the cartridge and the other end thereof protrudes from an outer surface of the cylinder; and a second contact disposed in the cylinder body to transmit high voltage power to the outer case of the cartridge through the first contact.

30. The smart electroshock device according to claim 9, wherein the battery is a rechargeable secondary battery, the secondary battery comprising a recharging circuit to be recharged by a DC power supply without an external charging device.

31. The smart electroshock device according to claim 10, further comprising:

a capacitor disposed in the main body and electrically connected to the high voltage generator, wherein the capacitor removes high voltage electricity remaining in the stun generator after discharge of high voltage from the stun generator.

32. The smart electroshock device according to claim 1, further comprising:

a gyro sensor disposed in the main body to measure a launch angle of the projectile; and a gyro circuit controlling the smart electroshock device not to launch the projectile when the launch angle of the projectile measured by the gyro sensor falls outside a predetermined range.

33. A smart electroshock device comprising:

a main body provided therein with electronic components to launch a projectile, the projectile being adapted to be stuck in a target and apply an electric shock to the target;

a cylinder body coupled to the main body and comprising a cylinder;

a plurality of cartridges mounted in the cylinder and each comprising the projectile, wherein the projectile is launched from the cylinder through a muzzle formed on a front side of the cylinder body through manipulation of the main body; and a stun generator disposed on the front side of the cylinder body to discharge high voltage electricity through manipulation of the main body, wherein, after being launched, the projectile is supplied with high voltage power from the main body via a wire connected to the projectile through a muzzle formed in the cylinder body, and the smart electroshock device further comprises: a blade rotor disposed in front of the cylinder to cut the wire, and a blade base is disposed in front of the blade rotor to cut the wire in cooperation with the blade rotor when the blade rotor is rotated.

* * * * *